US005581030A

United States Patent [19]

Conroy

[11] Patent Number: 5,581,030

[45] Date of Patent: Dec. 3, 1996

[54] DOUBLE POCKET DRUM MUTE

[76] Inventor: Douglas M. Conroy, 38 Deanna Dr., Apt. 98, Somerville, N.J. 08876

[21] Appl. No.: 602,883

[22] Filed: Feb. 16, 1996

[51] Int. Cl.[6] ..... G10D 13/02

[52] U.S. Cl. ..... 84/411 M

[58] Field of Search ..... 84/411 M, 411 R, 84/414

[56] References Cited

U.S. PATENT DOCUMENTS

| | | | |
|---|---|---|---|
| 4,244,266 | 1/1981 | Hardy | 84/411 M |
| 4,325,280 | 4/1982 | Hardy | 84/411 M |
| 4,325,281 | 4/1982 | Hardy | 84/411 M |
| 4,567,807 | 12/1986 | Robinson | 84/411 M |
| 4,671,158 | 6/1987 | Saputo | 84/411 M |
| 4,899,635 | 2/1990 | Santangelo | 84/411 M |
| 5,107,741 | 4/1992 | Beals et al. | 84/411 M |

*Primary Examiner*—Patrick J. Stanzione
*Attorney, Agent, or Firm*—Horst M. Kasper

[57] ABSTRACT

A double pocket drum mute having a structure which is made of three layers, namely an outer sheet (22), an inner sheet (24), and a padding sheet (20). The inner sheet exhibits a slot dividing the inner sheet into two parts. Each part of the inner sheet together with the padding sheet form a pocket. The slot allows to put an ingot into each pocket. The structure exhibits two holes disposed near edges running parallel to each other. A latchet string is threaded through the holes and tied. The double pocket drum mute is bound to the drum by the latchet string to mute the undesirable overtones.

9 Claims, 6 Drawing Sheets

DOUBLE POCKET DRUM MUTE

BACKGROUND OF THE INVENTION

1. Field of the Invention

The present invention relates to accessories for musical instruments, specifically to drums and associated mutes for muffling unwanted overtones.

2. Brief Description of the Background of the Invention Including Prior Art

It is recognized by those skilled in the art of recording and percussion performance that drums can create an undesirable overtone and ringing effect when hit. Drummers commonly attempt to muffle the ringing effect and let the desired musical tone sound through. An effective means for muffling is to simply lay an object on the drum head next to the counterhoop.

The U.S. Pat. No. 4,671,158 to Saputo teaches a drum resonance eliminator. The reference teaches in col. 3, starting with line 44, that a support member 36 carries a resilient pad which is inserted over the rod 44 and that a set screw 48 is tightened to secure the support member 30 at the desired position over the drum head 32. This construction of the reference results in a more or less permanent muffling and damping of the drum which is kind of difficult to change during operation of the drum or during the short-term intervals during a concert. In U.S. Pat. No. 4,671,158 to Saputo, the components of the device have threaded rod screws and wing-nuts that tend to strip from use and loosen during play resulting in a variation of pressure on the drumhead. Being affixed to the counter hoop, when disengaged, is undesirable when brushes are used rather than drumsticks during play.

The U.S. Pat. No. 4,567,807 to Robinson teaches a muting and muffling of drums. The reference uses a mute body 11 having a pair of attaching flanges 12 and 14 and these flanges are attached to the drum 21. Again in this situation, it would be difficult to make any changes to the level of muting and muffling which occurs during a concert. The U.S. Pat. No. 4,567,807 to Robinson is limited to the weight of the leather pieces sewn together, requiring several mutes of various weight for adjustability. Furthermore, the leather piece being affixed to the counterhoop of the drum with "velcro-like" material, requires the entire diameter of the counterhoop to support the material for flexibility in placement.

The U.S. Pat. 4,244,266 to Hardy teaches a drumhead deadening device. The deadening devices 12 and 14 are attached to the membrane of the drum. This construction results in the situation, where it is again difficult to change the intensity or the level of the muting and deadening during a performance.

The U.S. Pat. No. 4,325,281 to Hardy teaches a drumhead ring reducer. A body of porous pliable material, such as polyester, is disposed within the drum shell and reacts with the drum membrane. An adhesive layer is disposed on the body for attaching the body to the drum shell. In view of the adhesive attachment taught in the U.S. Pat. No. 4,325,281, it is again not possible during a performance to change the level of reducing the drumhead ring.

Both the U.S. Pat. No. 4,244,266 and the U.S. Pat. No. 4,325,281 to Hardy disclose the adhesion of foam to the drumhead. Be it inside or outside the drumhead, a full circle of muffling suppresses the desirable musical tones in addition to the undesirable ringing effect. Also, since the foam is affixed with adhesive, it is not easily engaged and disengaged, or reused.

The U.S. Pat. No. 4,325,280 to Hardy teaches a device for deadening drum heads. The device 15 including bodies 16, 18 and 20 is disposed on the attack head 12 to minimize the ringing of the attack head. Furthermore, a device 21 including bodies 22, 24, and 26 is disposed on the resonating head 14 to minimize ringing of the resonating head. This reference again teaches a permanent system of muting where it is impossible to change the muting level during a performance.

The U.S. Pat. No. 4,899,635 to Santangelo teaches a drum mute. The drum mute of the reference has a thin flexible resilient sheet which can be adhered to the drumhead. The undersurface of the sheet includes an adhesive to adhere to the drumhead and an area of felt. Again, this reference teaches to use an adhesive to adhere to the drumheads and, consequently, the structures taught in the Santangelo reference are unsuitable for modification during operation and during performance. Also, a layer of tack adhesive picks up dirt particles, further weakening the temporary bond.

Thus, all mutes heretofore known suffer from a number of disadvantages:

- Engaging or disengaging the mute which is affixed to the drumhead through use of threaded rods, screws, wing-nuts, and especially adhesive can be complicated and time-consuming, requiring the use of both hands. This scenario is undesirable for the drummer in a concert setting and also results in inconsist placement and pressure of the mute while on the drumhead;
- Once disengaged, drummers are faced with the problem of how to discard the mute in a concert setting. Often they are thrown on the floor, where their adhesives collect dirt or rug fibers or damage occurs when they are stepped on.

SUMMARY OF THE INVENTION

1. Purposes of the Invention

It is an object of the present invention to provide a mute which can be rapidly engaged or disengaged with a flick of the wrist.

It is another object of the present invention to provide a mute which is adjustable in placement and weight.

It is a further object of the present invention to provide a mute which remains consistent in placement and weight when engaged.

It is another object of the present invention to provide a mute which is not subjected to damage and remains affixed to the drum when disengaged.

It is still another object of the present invention to provide a mute which will be clear of the counterhoop and drumhead when disengaged.

These and other objects of and advantages of the present invention will become evident from the description which follows.

2. Brief Description of the Invention

The present invention provides for a double pocket drum mute comprising an outer sheet having a first hole and a second hole. The double pocket drum mute further consists of a padding sheet attached to an inner side of the outer sheet having a first hole and a second hole. The first hole of the padding sheet matches the position of the first hole of the outer sheet. The second hole of the padding sheet matches the position of the second hole of the outer sheet. A first inner sheet covers about half of the padding sheet. Its first hole matches the position of the first hole of the outer sheet and has edges on three sides attached to edges of the outer sheet. A fourth edge of the first inner sheet together with a center area of the padding sheet and a center area of the first inner sheet forms a first pocket. A second inner sheet substantially covers a remaining part of the padding sheet and has a second hole matching the second hole of the outer sheet and the second hole of the padding sheet. The second inner sheet is attached at three edges to remaining edges of the outer sheet. The first inner sheet and the second inner sheet substantially covers a side of the outer sheet furnished with the padding sheet. A fourth edge of the second inner sheet together with a center area of the padding sheet and a center area of the second inner sheet forms a second pocket. The double pocket drum mute has a first ingot placed inside the first pocket and a second ingot placed inside the second pocket. A latchet string is provided to be threaded through the first hole of the outer sheet, the first hole of the padding sheet, the first hole of the first inner sheet and through the second hole of the second inner sheet, the second hole of the padding sheet, and the second hole of the outer sheet. The latchet string ties the double pocket drum mute together. After folding the double pocket drum mute, an edge is formed by a slot represented by the fourth edge of the first inner sheet and by the fourth edge of the second inner sheet. The latchet string allows to bind the double pocket drum mute to a tensioning element of a drum such that the double pocket drum mute rests on the attack head of the drum and alternatively be removed and be placed on the side of the shell of the drum.

The outer sheet, the inner sheet, and the latchet string can be made of leather. The ingots can be made of lead. The padding sheet can be made of polyurethane foam.

A third ingot can be placed side by side with and next to the first ingot into the first pocket. A fourth ingot can be placed side by side with and next to the second ingot into the second pocket. The four ingots can be placed substantially to form with their centers a first rectangle when the outer sheet is disposed flat and substantially to form with their centers a second rectangle when the drum mute is in a folded assembled state.

The diameter of the latchet string can be adapted such that a double of the latchet string fits under friction through the first holes and through the second holes.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

In the accompanying drawings, in which are shown several of the various possible embodiments of the present invention.

DESCRIPTION OF INVENTION AND PREFERRED EMBODIMENT

Figure 1:
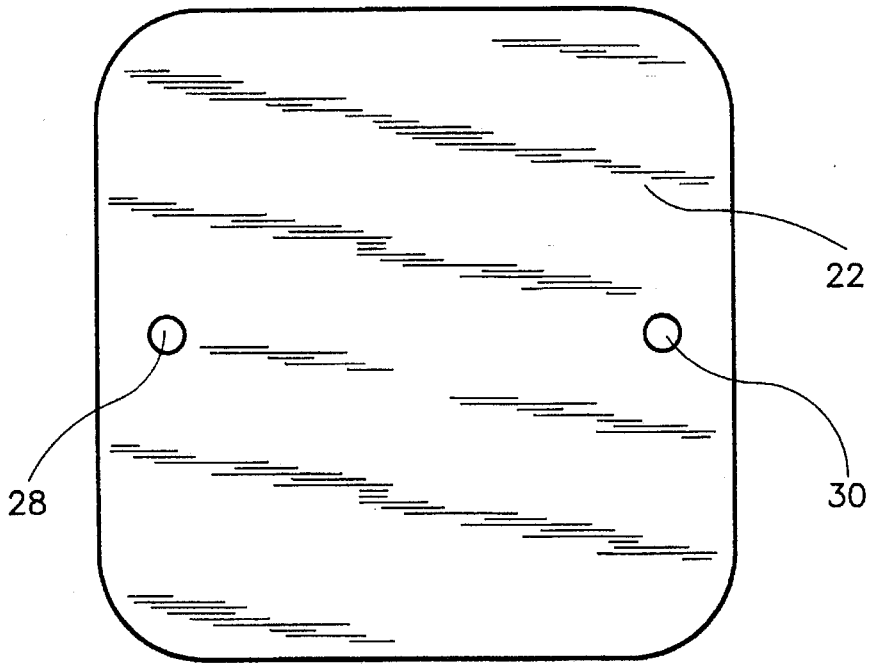
FIG. 1 is a bottom plane view of a double pocket drum mute.

A double pocket drum mute of the present invention comprises a structure which is made of three layers, namely an outer sheet 22, an inner sheet 24, and a padding sheet 20. The padding sheet 20 is disposed between the inner sheet 24 and the outer sheet 22 and is attached to the inner side of the outer sheet. FIG. 1 shows a view of the outer sheet 22 in the assembled form. Two holes 28 and 30 are present in the outer sheet 22.

Figure 2:
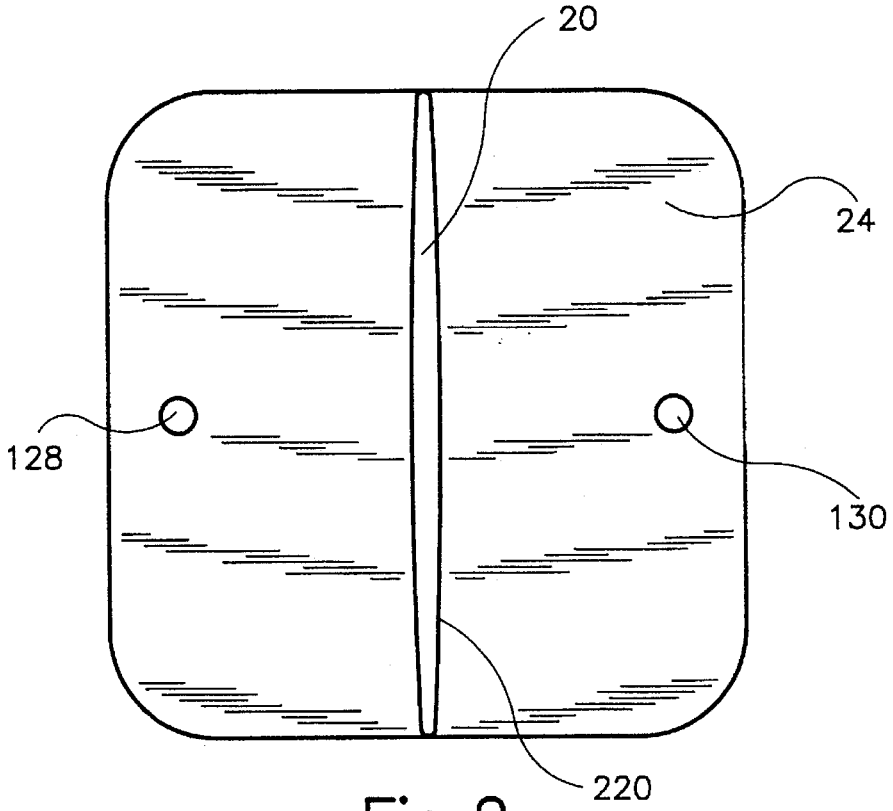
FIG. 2 is a top plane view of a double-pocket drum mute.
Figure 3:
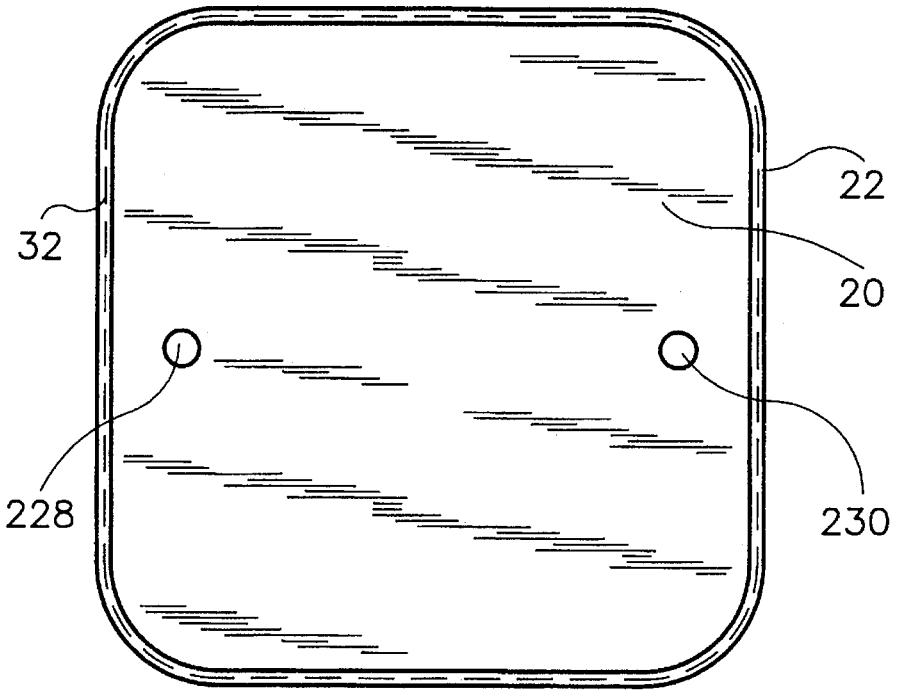
FIG. 3 is a bottom view of a double pocket drum mute turned inside out.

FIG. 2 shows the double pocket drum mute of FIG. 1 from an opposite side as that shown in FIG. 1 and the inner sheet 24 is now on top and visible. The inner sheet 24 has substantially the same shape as the outer sheet 22, however, it is furnished with a slot 220. The slot 220 divides the inner sheet 24 into two parts. The slot 220 preferably extends from one edge of the double pocket drum mute to another edge running parallel to the first one. The position of the slot 220 is preferably symmetrical such that the two pockets formed by the slot have the same size and shape. The inner sheet 24 is attached at the outer edges to outer edges of the outer sheet 22. The inner sheet 24 is furnished with holes 128, 130 which are positioned on the inner sheet 24 such that they are aligned with the holes 28 and 30, respectively, of the outer sheet 22. The padding sheet 20 is attached to an inner side of the outer sheet 22 and is visible through the slot 220 in the inner sheet 24 according to FIG. 2. The slot 220 gives access to two pockets between the padding sheet 20 and the inner sheet 24. FIG. 3 is a view of the embodiment of FIGS. 1 and 2, however, turned inside out. In FIG. 3, the padding sheet 20 is substantially visible bordered by a part of the outer sheet 22. The padding sheet 20 is furnished with holes 228 and 230 which correspond in their position to the holes 28 and 30, respectively, of the outer sheet and to the holes 128 and 130, respectively, of the inner sheet 24. The holes 28, 128, 228 and 30, 130, 230 are in general positioned such that they are mere images of each other relative to the slot 220 of the inner sheet 24. This means that the holes 28, 128, 228 and 30, 130 and 230 are substantially centered relative to a line which is parallel to the slot 220. The holes 28, 128, 228 are positioned relative to the holes 30, 130, 230, respectively, such that, upon folding the double pocket drum mute along the slot 220, the hole positions 30, 130, 230 and 28, 128, 228 are substantially superpositioned such that a latchstring or latchet string can be pulled through these holes and can fasten the double pocket drum mute such that the two parts of the inner sheet 24 are contacting and resting side by side.

The position of the hole 28, 30, 128, 130, 228, 230 can have a distance of from about 0.5 to 2 cm and preferably of from 0.8 to 1.5 cm between the axis of the hole 28, 30, 128, 130, 228, 230 and the nearest outer edge of the assembled double pocket drum mute. The size of the hole can be from about 3 mm to 1 cm and is preferably from about 0.4 to 0.6 min.

The general shape of the double pocket drum mute can be round or rectangular and, in case of rectangular, a square shape is preferred or, alternatively, an elongated shape can be preferred, where the longer side of the rectangle is the side parallel to a line connecting the holes 28, 30, and where the shortest side of the rectangle is extending in the longitudinal direction of the slot 220. The edges of the rectangle of the double pocket drum mute can have a length of from about 5–15 cm and preferably have a length of from about 8–10 cm.

The material for the outer sheet 22 and for the inner sheet 24 can be a resilient material, which is soft and which is pliable. Such materials include a vinyl, a leather, woven materials, cotton, wool, plastic, rubber. Leather appears to be a particularly preferred material. If leather is used, the outside is generally the smooth side of the inner sheet and the smooth side of the outer sheet. The inside of the inner sheet and of the inside of the outer sheet, respectively, corresponds to the rough side of the leather.

The padding sheet 20 is generally a soft material which will contain air bubbles to allow the material to adapt itself easily to forces exerted on a side of the material. Such foams can be foam rubber, latex foam rubber, polystyrene polymers and copolymers, soft polyvinyl chloride, polycarbonate, polyolefines, polyurethanes, polyisocyanurates and polycarbodiimides, polymethacrylimide phenolate and urea resins. Preferred are materials which have soft properties such that they can adapt their shape to forces exerted onto the foam.

The padding sheet employed can be a foam material having a thickness from about 5–10 mm. During a use and operation, such foam will generally flatten down in view of the weight imposed on the foam.

The inner sheet, the padding sheet, and the outer sheet are held together by a seam 32 at the outer edge. The seam 32 can be provided by stitching, by adhesive attachment, by gluing, by hot pressing and other methods. As shown in FIG. 3, the seam 32 is generally provided such that it is on the inside of the double pocket drum mute when the double pocket drum mute is in its operational position.

Figure 4:
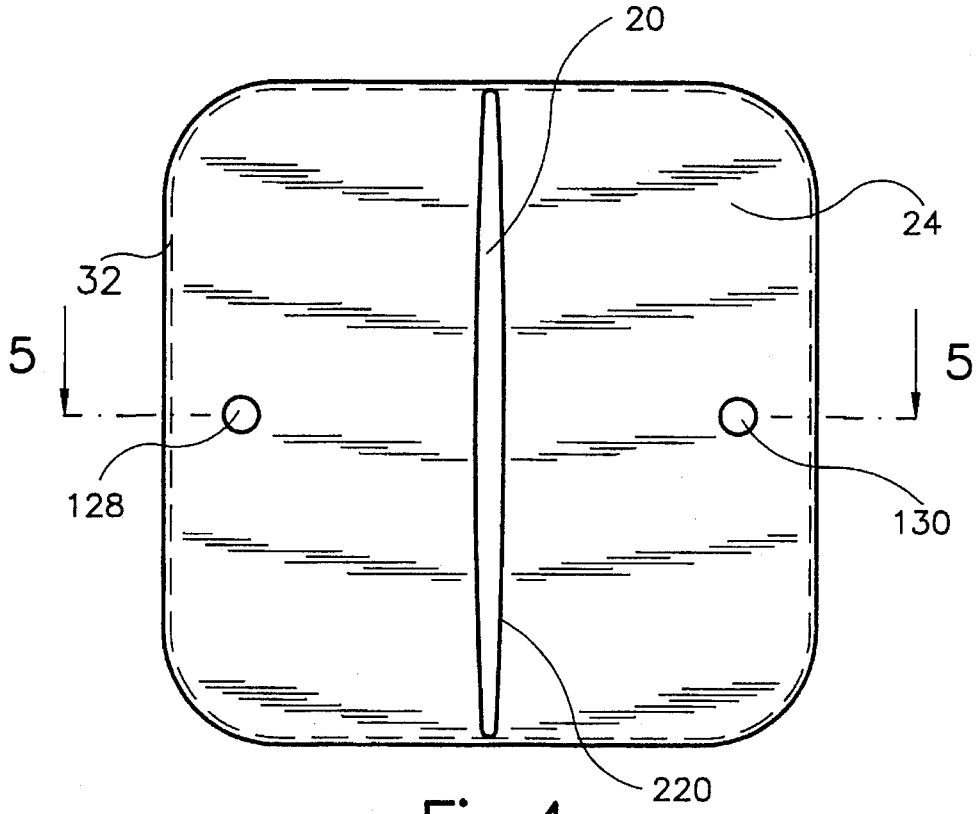
FIG. 4 is a top view of a double pocket drum mute turned inside out.

The stitching of the double pocket drum mute as shown, e.g. in FIGS. 3 and 4, results in more internal space inside the pockets for the ingots as compared to a situation, where the stitching would be normally visible from the outside.

Figure 6:
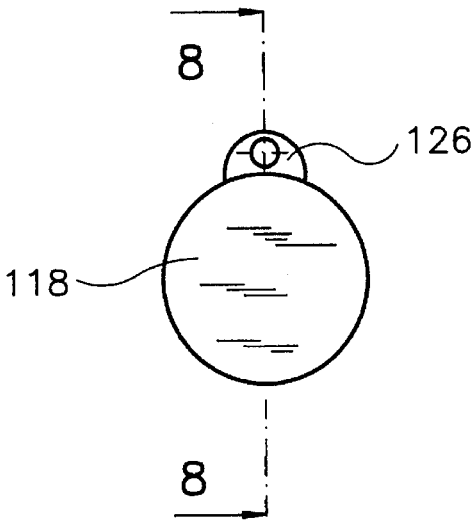
FIG. 6 is a view of a first embodiment of an ingot.
Figure 7:
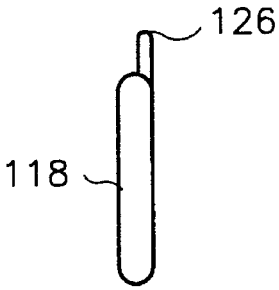
FIG. 7 is a side elevational view of the ingot of FIG. 6.
Figure 8:
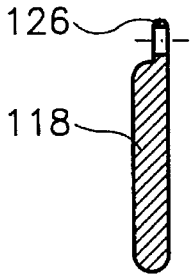
FIG. 8 is a sectional view of the ingot along section line 8—8 of FIG. 6.

The ingot 118 shown in FIG. 6 preferably has a round flat shape. The diameter of the ingot relative to the thickness of the ingot can be from about 2–6 times the thickness and preferably from about 3–5 times the thickness of the ingot. As shown in FIG. 6, a hook 126 can be attached to the ingots which would allow to tie the ingots together in order to avoid a loss of an ingot. The ingot is preferably made of a dense and heavy material such as a metal. The ingot can be made of material which is sound-absorbing and which has a relatively high weight. Such ingots can be made from lead, tin, bronze. Alternatively, the ingots could be made of sand, contained in a correspondingly-shaped small bag, or of little metal balls contained in a small bag, where the bag is made of, e.g. plastic, a tightly woven material, where such material would not allow the contents of the bag to escape.

Figure 5:
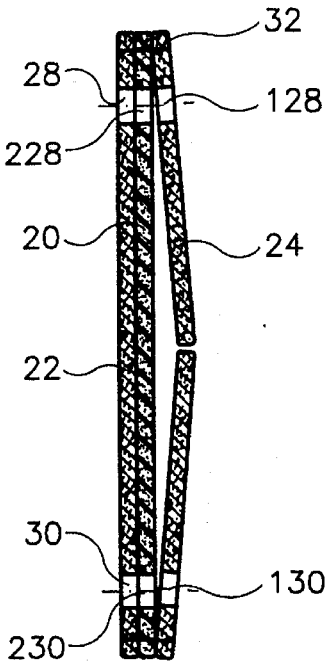
FIG. 5 is a sectional view of a double pocket drum mute turned inside out, along section line 5—5 of FIG. 4.

FIG. 5 shows a sectional view of the configuration of FIG. 4 turned inside out, where the section line is passing through the holes 128, 130. It can be recognized from FIG. 5 how the holes 28, 128, 228 are aligned with, respectively, the holes 30, 130, 230.

Figure 9:
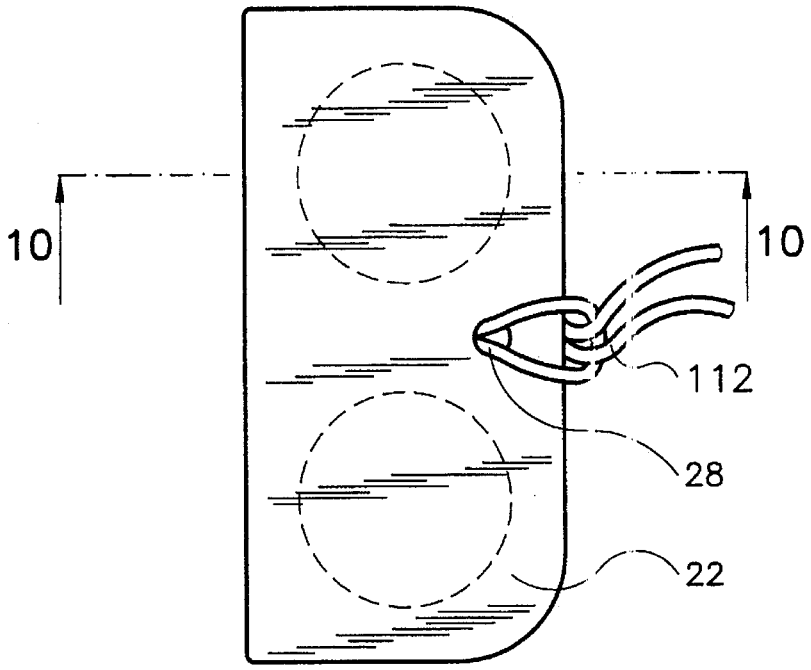
FIG. 9 is a top view of an assembled double pocket.

FIG. 9 shows a perspective view onto an assembled double pocket drum mute.

Where the shape of the double pocket drum mute is rectangular, it is particular suitable to have each quadrant of the drum mute placed around an ingot.

Figure 10:
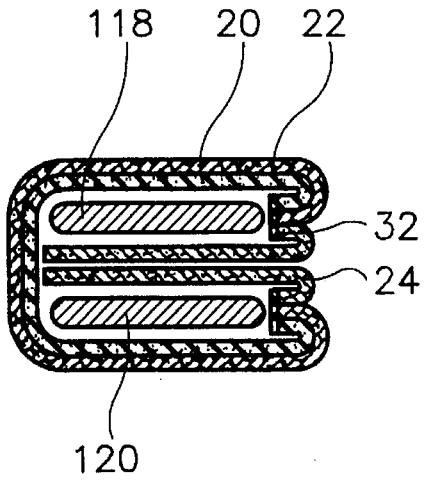
FIG. 10 is a sectional view along section line 10—10 of FIG. 9.
Figure 14:
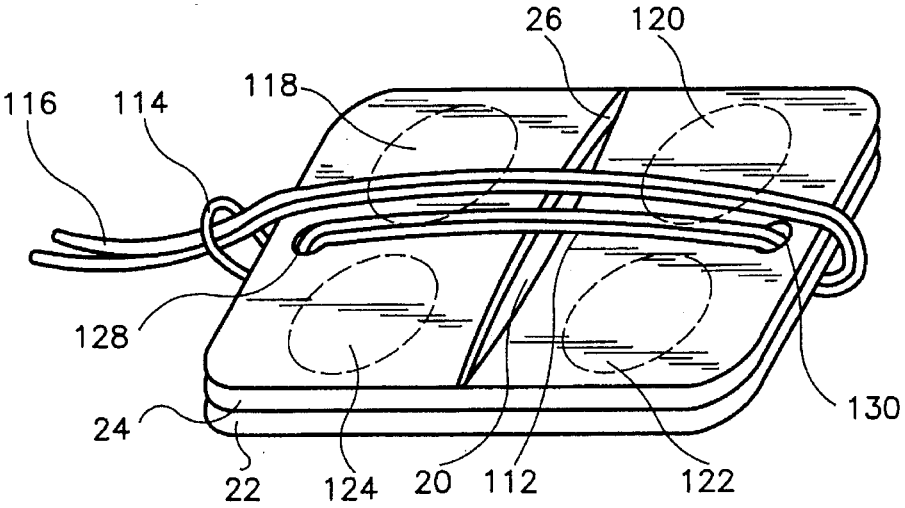
FIG. 14 is a top view similar to that of FIG. 2, however, in the presence of the latchet string of FIG. 11.

Once the double pocket drum mute is in its assembled position, as shown in FIG. 9 and in a cross-sectional view in FIG. 10, a structure results which contains four ingots 118, 120, 122, 124, as shown in FIG. 14, where the four ingots are disposed like the corners of a rectangle, and where the inner sheets of the double pocket drum mute are placed between in each case two ingots 118, 120 facing each other with their back sides. In each level of the double pocket drum mute, the position of the two ingots resembles these positions, which would correspond to the charge centers of an idealized dipole.

The double pocket drum mute is kept in its assembled position shown in FIGS. 9 and 10 by a latchet string 112. The latchet string 112 could be provided by a material which is used for the production of shoe laces or other laces. The holes 28, 30, 128, 130, 228, 230 are employed to fasten the latchet string 112 to the double pocket drum mute and to define the shape of the folded double pocket drum mute as shown in FIGS. 9 and 10. According to a preferred embodiment, a loop of the latchet string 112 has a length of at least about 4 times the side edge of the pocket drum mute and preferably from about 6–10 times the length of an edge of the double pocket drum mute. The latchet string 112 is folded together with the substantially equal length pieces and a loop is formed at about the middle of the total length of the original unfolded latchet string. This loop of the latchet string is then passed first through the holes 30, 230, 130, 128, 228 and 28. Once the loop has passed through the hole 30, the residual ends of the latchet string 112, hanging out of hole 30, are threaded through the loop and tightened. This results in a folding of the double pocket drum mute along the line of the slot such that the inner sheets contact each other. Now the double pocket drum mute can be held by the latchet string 112.

FIG. 14 shows the folding of the double pocket drum mute with latchet string prior to tightening and folding along the slot 26. After folding along the slot 26, the double pocket drum mute assumes the configuration shown in FIGS. 9 and 10. The position of four ingots 118, 120, 122, 124 can be recognized from FIG. 14 and, in particular, that these four ingots 118, 120, 122, 124 will have their centers positioned such that the contours form the corners of a square.

Figure 15:
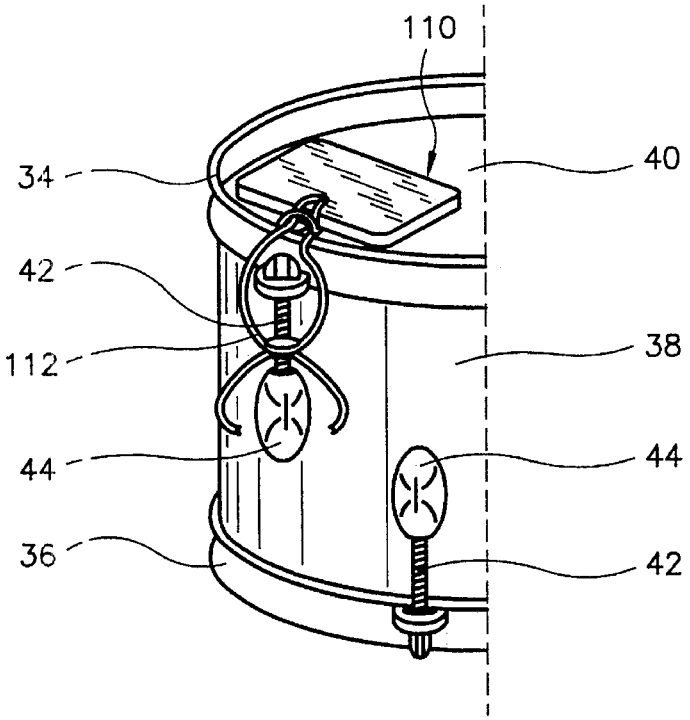
FIG. 15 is a perspective view of a double pocket of a drum mute placed on a drum for muting.

FIG. 15 shows how the latchet string of the double pocket drum mute 110 is attached to an elastic tensioning element or tension rod 42 having a lug 44 attached to the drum for holding the upper counter hoop 34. Alternatively, an elastic tensioning element can be provided between the upper counter hoop 34 and the lower counter hoop 36 and the latchet string 112 can be attached to such an elastic element. The tensioning element retains the upper counter hoop 34 of the attack head 40 and the lower counter hoop 36 of the resonant head 40 together, FIG. 15 shows the double pocket drum mute resting on the batter head or attack head 40 of the drum. In this position, muting and damping of the vibrations of the attack head 40 of the drum will occur. If it is desired to release the attack head and to remove the muting and damping, then the double pocket drum mute 110 can be easily flipped into the position shown in FIG. 16.

The position of the double pocket drum mute 110 is generally near the outer periphery of the attack head 40 of the drum.

Figure 16:
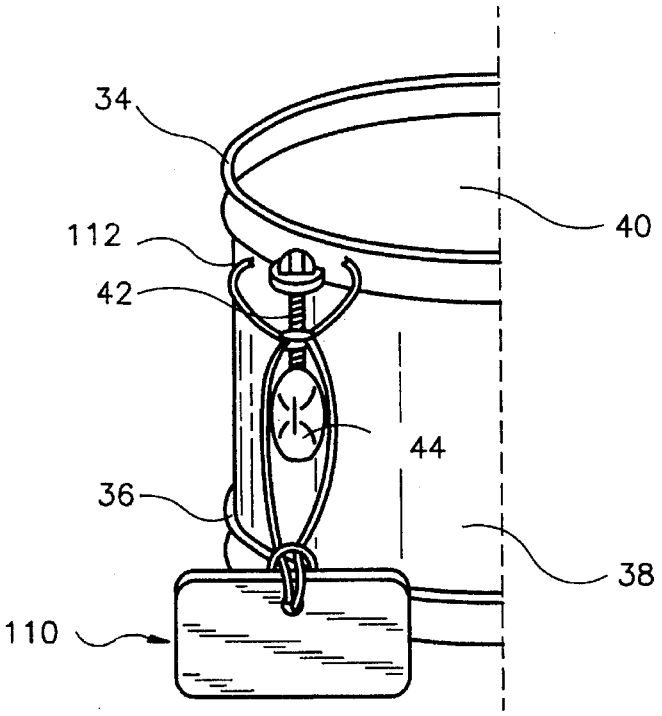
FIG. 16 is a perspective view of a double pocket drum mute attached to a drum in a non-damping position.

According to FIG. 16, the attack head 40 of the drum is free to vibrate. The construction allows a drum operator to remove or to put into position the double pocket drum mute 110 very easily and to change the drum from a muted to a non-muted state and vice versa easily and quickly during operation. In addition, the soft surface of the double pocket drum mute 110, e.g. when such surface is made of a leather material, will avoid any interfering sound such that the positioning and the removal of the double pocket drum mute will not be associated with a noise which could be unpleasant to the ears of the listeners of a performance.

Figure 12:
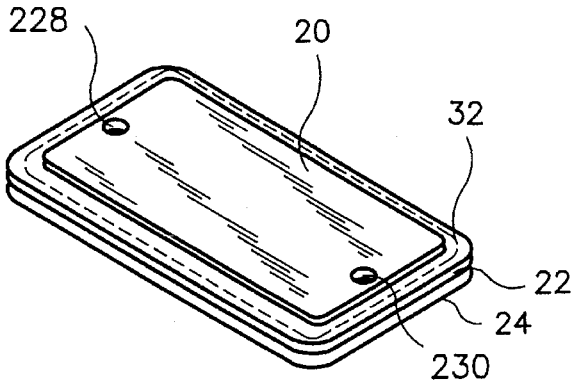
FIG. 12 is a view similar to that of FIG. 3 for a second embodiment having a rectangular shape.
Figure 13:
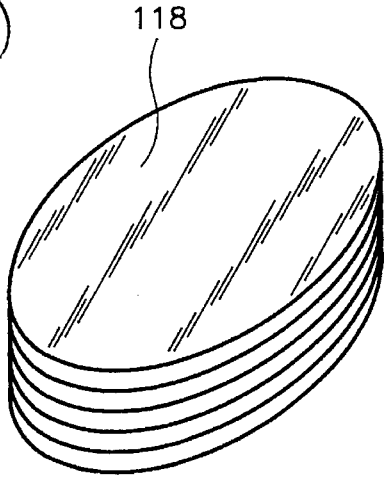
FIG. 13 is a perspective view of a second embodiment of an ingot.

FIG. 12 shows an embodiment similar to the embodiment shown in FIG. 3, however, in this structure the double pocket drum mute is not of square shape but has the shape of an elongated rectangle. The shape of an elongated rectangle can be particularly suitable where it is desired to use only two ingots 118, shown in FIG. 13, in connection with the double pocket drum mute.

Figure 11:
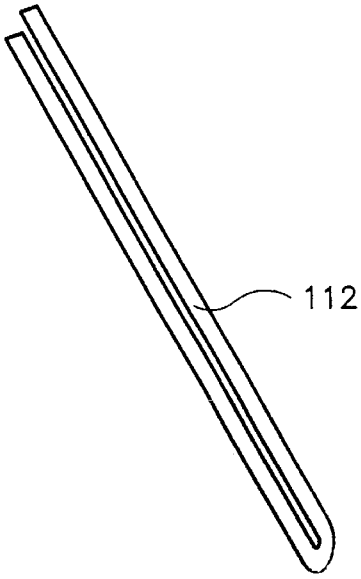
FIG. 11 a view of a latchet string.

The latchet string 112 is shown in FIG. 11, with the loop center at the bottom. The latchet string can be made from a suitable material such as leather, fabric or plastic. The cross-section of the latchet string can have different shapes such as round or oval or rectangular. For elegance, stability, and durability, a leather band with rectangular cross-section is preferred. The rectangular cross-section ensures that substantial friction occurs such that once the double pocket drum mute is tightened, it remains tight based on the friction of the leather band and does not separate unless intentionally untied and unlaced.

The structure of the double pocket drum mute allows to employ different ingots in connection with the same double pocket. Consequently, the damping level present can be varied by changing the ingots employed. The double pocket allows easy insertion and removal of such ingots as desired. The ingots can be distinguished by various weights and to some extent by their size and shape. The double pocket drum mute of the present invention is easily removable from the plane surface of the drum, such that the attack head of the drum can freely vibrate after removal of the double pocket drum mute.

The drum mute of the present invention is associated with the advantage that it minimizes a change of pitch. This is in contrast to internal muffles attached to an ??attack head of a drum which change the pitch and, in addition, to provide muting. The present double pocket drum mute allows to control the pressure which is placed on the attack head of the drum by the double pocket drum mute based on the weight of the ingots. Such a consistent change or adjustment is not possible in conventional structures such as those shown in the U.S. Pat. No. 4,671,158 to Saputo.

The size of the muting effect is controllable by the size of the double pocket drum mute. A larger size double pocket drum mute with a heavier weight would result in a larger damping of a muting effect as compared to a smaller size.

It will be understood that each of the elements, or two or more together, may find a useful application in other types of drum mutes, differing from the types described above.

While the invention has been illustrated and described as embodied in the context of a double pocket drum mute, it is not intended to be limited to the detail shown, since various modifications and Structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A double pocket drum mute comprising an outer sheet having a first hole and a second hole;

a padding sheet attached to an inner side of the outer sheet and having a first hole and a second hole, where the first hole of the padding sheet matches the position of the first hole of the outer sheet, and where the second hole of the padding sheet matches the position of the second hole of the outer sheet;

a first inner sheet covering about half of the padding sheet and of the outer sheet and having a first hole matching the position of the first hole of the outer sheet and of the padding sheet and having an edge on three sides which is attached to an edge of the outer sheet, and wherein the fourth side of the first inner sheet together with a center area of the outer sheet and padding sheet form a first pocket;

a second inner sheet having a second hole matching in the position of the second hole of the outer sheet and of the padding sheet and attached at three edges to the outer edge of the outer sheet such that the first inner sheet and the second inner sheet substantially cover the side of the outer sheet furnished with the padding sheet, and wherein a fourth side of the second inner sheet together with a center area of the outer sheet and of the padding sheet form a second pocket;

a first ingot to be placed inside of the first pocket;

a second ingot to be placed in the second pocket; a latchet string to be thread through the first holes and through the second holes to tie the double pocket drum mute together such that an edge is formed by a slot represented by the fourth side of the first inner sheet and by the fourth side of the second inner sheet and said latchet string serving for attaching the double pocket drum mute to tensioning element of a drum such that the double pocket drum mute can rest on the attack head of the drum and alternatively be removed and be placed on the side of the shell of the drum.

2. The double pocket drum mute according to claim 1, wherein the outer sheet is made of leather.

3. The double pocket drum mute according to claim 1, wherein the inner sheet is made of leather.

4. The double pocket drum mute according to claim 1, wherein the latchet string is made of leather.

5. The double pocket drum mute according to claim 1, wherein the ingots are made of lead.

6. The double pocket drum mute according to claim 1, wherein the padding sheet is made of polyurethane foam.

7. The double pocket drum mute according to claim 1, further comprising a third ingot to be placed side by side with and next to the first ingot into the first pocket;

a fourth ingot to be placed side by side with and next to the second ingot into the second pocket; and wherein the four ingots are placed substantially to form with their centers a first rectangle when the outer sheet is disposed flat and substantially to form with their centers a second rectangle when the drum mute is in a folded assembled state.

8. The double pocket drum mute according to claim 1, wherein the diameter of the latchet string is adapted such that a double of the latchet string fits under friction through the first holes and through the second holes.

9. A double pocket drum mute comprising an outer sheet having a first hole and a second hole;

a padding sheet attached to an inner side of the outer sheet and having a first hole and a second hole, where the first hole of the padding sheet matches the position of the first hole of the outer sheet, and where the second hole of the padding sheet matches the position of the second hole of the outer sheet;

a first inner sheet covering about half of the padding sheet and having a first hole matching the position of the first hole of the outer sheet and having edges on three sides attached to edges of the outer sheet, and wherein a fourth edge of the first inner sheet together with a center area of the padding sheet and a center area of the first inner sheet form a first pocket;

a second inner sheet covering substantially a remaining part of the padding sheet and having a second hole matching the second hole of the outer sheet and the second hole of the padding sheet and attached at three edges to remaining edges of the outer sheet such that the first inner sheet and the second inner sheet substantially cover a side of the outer sheet furnished With the padding sheet, and wherein a fourth edge of the second inner sheet together with a center area of the padding sheet and a center area of the second inner sheet form a second pocket;

a first ingot to be placed inside the first pocket;

a second ingot to be placed inside the second pocket; and a latch-string to be thread through the first hole of the outer sheet, the first hole of the padding sheet, the first hole of the first inner sheet and through the second hole of the second inner sheet, the second hole of the padding sheet, and the second hole of the outer sheet to tie the double pocket drum mute together such that an edge is formed after folding the double pocket drum mute by a slot represented by the fourth edge of the first inner sheet and by the fourth edge of the second inner sheet, wherein the latch-string allows to bind the double pocket drum mute to a tensioning element of a drum such that the double pocket drum mute can rest on the attack head of the drum and alternatively be removed and be placed on the side of the shell of the drum.

* * * * *